US010441842B2

(12) United States Patent
Bell et al.

(10) Patent No.: US 10,441,842 B2
(45) Date of Patent: Oct. 15, 2019

(54) ELECTRONICALLY POWERED ILLUMINATING MAT FOR YOGA AND EXERCISE

(71) Applicants: R. Brandon Bell, West Palm Beach, FL (US); Aaron Edleson, Jupiter, FL (US)

(72) Inventors: R. Brandon Bell, West Palm Beach, FL (US); Aaron Edleson, Jupiter, FL (US)

( * ) Notice: Subject to any disclaimer, the term of this patent is extended or adjusted under 35 U.S.C. 154(b) by 0 days.

(21) Appl. No.: 15/585,981

(22) Filed: May 3, 2017

(65) Prior Publication Data

US 2019/0038953 A1 Feb. 7, 2019

(51) Int. Cl.
*A63B 21/00* (2006.01)
*E04H 15/56* (2006.01)
(Continued)

(52) U.S. Cl.
CPC ..... *A63B 21/4037* (2015.10); *A63B 71/0622* (2013.01); *E04H 15/56* (2013.01); *F21S 10/00* (2013.01); *F21V 33/008* (2013.01); *H05B 33/0845* (2013.01); *H05B 33/0857* (2013.01); *H05B 37/0272* (2013.01);
(Continued)

(58) Field of Classification Search
CPC ..... E04H 15/02; E04H 15/10; E04H 15/32; E04H 15/56; A63B 21/4037; A63B 21/00; A63B 71/0622; A47G 9/06; A47G 9/062; A47G 9/1045; A47G 9/0223; F21L 4/02; F21L 4/027; F21V 15/01; F21V 33/008; F21Y 2103/10; F21Y 2115/10; H05B 33/0845; H05B 33/0857; H05B 37/0272; H05B 37/0281
USPC ..... 135/91, 96, 137, 116, 120.1; 5/414, 5/417–418; 362/555; 482/8–9, 83
See application file for complete search history.

(56) References Cited

U.S. PATENT DOCUMENTS 7,455,427 B1 * 11/2008 Freeman ..... E04H 15/10 135/91
7,456,755 B2 * 11/2008 Blum ..... A47L 23/22 340/691.6
(Continued)

FOREIGN PATENT DOCUMENTS

KR 200474026 8/2014
WO 2016033238 3/2016

OTHER PUBLICATIONS

Amazon.com : Light LED Lighted Mouse Pad with 4 Port High Speed USB 2.0 Hub (New version), https://www.amazon.com/Light-Lighted-Mouse-Speed-version/dp/BOOTFLYGLY.
(Continued)

*Primary Examiner* — Winnie Yip
(74) *Attorney, Agent, or Firm* — Lambert Shortell & Connaughton; Gary E. Lambert; David J. Connaughton, Jr.

(57) ABSTRACT

An electronically powered, light emitting, portable mat with built in storage container is provided. The light is configured to provide illumination from the ground as well as a visual timing signal for exercise routines and enhanced experiences. The built in storage area also allows for the mat to be used as a backpack which can be unrolled into a floor mat. The light up mat may be particularly useful for exercising or camping in dark areas, as well as for mood lightning outdoors to illuminate the surrounding area.

14 Claims, 8 Drawing Sheets

(51) Int. Cl.

| | |
|---|---|
| ***F21V 33/00*** | (2006.01) |
| ***H05B 33/08*** | (2006.01) |
| ***H05B 37/02*** | (2006.01) |
| ***A63B 71/06*** | (2006.01) |
| ***F21S 10/00*** | (2006.01) |
| *F21Y 115/10* | (2016.01) |
| *F21Y 103/10* | (2016.01) |

(52) U.S. Cl.
CPC ..... *H05B 37/0281* (2013.01); *F21Y 2103/10* (2016.08); *F21Y 2115/10* (2016.08)

(56) References Cited

U.S. PATENT DOCUMENTS

| | | | | |
|---|---|---|---|---|
| 8,235,870 | B2 | 8/2012 | Hamilton | |
| 8,769,742 | B2 * | 7/2014 | Thornton | A47G 9/062 5/417 |
| 8,882,554 | B2 | 11/2014 | McKinney | |
| 9,129,513 | B1 * | 9/2015 | Clarke | G08C 17/02 |
| 9,475,426 | B1 * | 10/2016 | Bobo | B60N 3/042 |
| 2002/0028313 | A1 | 3/2002 | Blum et al. | |
| 2004/0004827 | A1 * | 1/2004 | Guest | G02B 6/0091 362/612 |
| 2009/0129104 | A1 * | 5/2009 | Shimano | B60N 3/048 362/459 |
| 2012/0122636 | A1 * | 5/2012 | Shurtleff | A63B 21/4037 482/142 |
| 2014/0357939 | A1 | 12/2014 | Theeuwes | |
| 2015/0034137 | A1 * | 2/2015 | Tanaeim | E04H 15/10 135/91 |
| 2015/0113731 | A1 * | 4/2015 | Liu | A63B 21/1473 5/417 |
| 2016/0059066 | A1 * | 3/2016 | Willis | A63B 21/1473 5/417 |
| 2016/0166876 | A1 * | 6/2016 | Goh | A63B 24/0062 482/9 |
| 2017/0266485 | A1 * | 9/2017 | Willis | A63B 21/4037 |

OTHER PUBLICATIONS

Amazon.com : Plixio 30 LED Ultra Soft LED Blanket that Lights Up & Changes Colors (3×4'): Home & Kitchen, https://www.amazon.com/Plixio-Blanket-Lights-Changes-Colors/dp/B00HM71AQW.

Holy Tech! Prayer Mats Light Up When Facing Mecca, http://mashable.com/2012/07/06/kickstarter-el-sajjadah/#ZnyBe7.Fg5qp.

Malamut, Melissa, MIT Students Created a Light Up Yoga Mat, Boston Magazine, Feb. 6, 2014.

New Light Up LED Yoga Mat GLOWS with Possibility, http://www.doyouyoga.can/new-light-up-led-yoga-mat-glows-with-possibility/.

The Glow Mat—Light Up Your Car Floor! Glow where you go. The Glow Mat™, originally designed to meet the demand for safe and secure lighting for av . . . , http://icrowdnewswire.com/2016/07/29/glow-mat-light-car-floor-glow-go-glow-mat-originally-designed-meet-demand-safe-secure-lighting-aviators-cockpit-n . . . .

* cited by examiner

ELECTRONICALLY POWERED ILLUMINATING MAT FOR YOGA AND EXERCISE

BACKGROUND OF THE INVENTION

Field of the Invention

The present invention relates to illuminated exercise devices. More particularly, the present invention relates to an electronically powered exercise mat having a light source to provide lighting for exercise and entertainment.

Description of Prior Art

The concept of a mat or pad has been around for ages. People have always wanted to use intermediate surfaces between themselves and the ground, both as a way to keep themselves or certain objects clean, as well as to protect from impact and make the surface more comfortable. With the rise of exercise, yoga mats and exercise mats were created to address this function and allow users to participate in activities which normally would be more painful, difficult and dirty if performed directly on the ground. With the invention of different types of flexible and soft materials, several different types of mats have evolved. Rubber, flexible plastic, foam, and even certain types of wood and other materials exist which people have formed into many sizes and shapes of mats. Common materials are known as NBR, TPE, PVC, or jute and may be made in various combinations of different materials as well as in a wide variety of size and thickness. They are also currently produced with various textures, logos, and other customizations. The typical use for these mats today is for exercise, such as yoga, or for lining gym floors to protect from heavy weights dropping.

In one known case, a mat was created with a full LED screen on top of the mat to instruct a user where to stand or place their hands for guiding exercise. However, this mat did not serve the purpose of providing comfort as the surface is hard, and it did not serve the purpose of being easily portable as it is heavy and requires significant energy usage, needing an AC outlet or significant battery. It's primary purpose is also an instructional tool offering little to no visual entertainment. It also would be quite expensive, and has not been made available for sale.

There are currently no mats available which are designed for portable use at night (other than mats which are affixed and used as a permanent floor) where a user could take the mat to an area with no lights, and have the mat provide the area light and experience enhancement. This is also true for various other activities for which a mat could be used, such as picnics at night, or for camping and as a sleeping mat in a tent. LED blankets exist, which serve the purpose of protecting the user from direct contact with the ground, and also serve to keep the user warm, but these blankets are not able to absorb any impact, and cannot serve to flatten and stabilize a surface to allow for activities such as yoga. Blankets are also made of comfortable materials such as cotton, which immediately pick up the dirt and bacteria from the ground and from the user and must be cleaned regularly. They are not made of the plastic and/or rubber materials of the yoga mat which are able to resist bacteria and only need the surface to be wiped for cleaning.

LED light strips, microcontrollers, remote controls and portable batteries have existed for several years. It is quite common for these items to be purchased together as a package and applied for any number of various uses, such as home lighting or lighting under vehicles. These LED light strips typically come with pre-programmed controllers, with or without remote controls, which have very standardized and common functions. Users can usually select any color, can adjust the brightness or the mode. There are a large number of different modes available, but they all do the same thing: flash or fade between different colors. For example, a user could select a program which cycles between three different colors, or seven different colors. They might also select a strobe function which only flashes one color. The user can usually adjust the speed slightly up or down. However, there is currently no product available which allows the user to select the specific time period which occurs between the color change effects. The timing is preset and can only move very slightly up or down, on the magnitude of mili-seconds. There are no products which allow the user to select an option to change the color every 30 seconds, for example, to time a yoga exercise, breathing or musical performance.

Additionally, backpacks are not a novel idea and have been around for ages. There are hundreds of available bags and back packs which are used to carry items and rest on the users back or shoulder. This causes a problem for a user who wants to carry a yoga or exercise mat, but is also wearing exercise attire which generally consists of little or no pockets. Users often carry several items, such as a wallet, keys, and a phone, but are forced to carry them in their hands or in a separate bag. Usually the user will have to leave their items on the ground next to the mat, where they could be damaged or lost. There are currently no exercise, camping, or other types of portable mats which also provide containers for carrying items, nor which have built in straps for carrying over both shoulders like a backpack.

SUMMARY OF THE INVENTION

The subject matter of this application may involve, in some cases, interrelated products, alternative solutions to a particular problem, and/or a plurality of different uses of a single system or article.

It is an object of the present creation to provide lighting onto mats made in various sizes and materials to allow a user to rest and/or exercise on the mat. It is another object of the system to create customized control options for the lighting to be used for timing exercises or programs, and also to create a compartment on such mats for storage of the power source as well as other items.

The present invention utilizes an already existing and familiar item: the exercise mat, also known as the yoga mat. These mats can already be made in any size, but are typically manufactured around 74×24 inches, in thicknesses from 2 mm to 25 mm. The addition of lights to the mats allows the potential use for the mats to be increased exponentially. Lights allow the mats to be used at night, for area lighting. They also allow for setting a mood, such as during a picnic, or for watching a concert. This also allows them to be used in a camping tent for both floor padding and lighting the tent, without needing to hang lanterns. The addition of lights creates a use for many other sizes of mats for things which they are not used for today, and also allows these activities to take place at night. It also allows for an expansion of the typical existing use for these mats. Rather than just an exercise class, the lighting may allow for themed exercise classes at night, for example, with flashing lights and fast paced music. In some embodiments, the lights may be controlled by a controller to change color, oscillate, and/or turn on and off in coordination with a music being played. This combination of existing technology is unique and there is no previous evidence of its design in prior art.

The power source may be custom or may be a standard available portable battery and may or may not be interchangeable or removable. In many embodiments, the battery or power source may be rechargeable, although replaceable batteries or power sources may also be used. The power source may also be configured to charge other items such as a phone. The power source may be of disposable type or rechargeable type including but not limited to lithium ion or lithium polymer. Also, direct plug-in embodiments are also contemplated herein. It should be understood however that the power source may be any source capable of providing power to the light source. In some embodiments, the mat may be made with the power source attached directly to it, while in others it may be separate from the mat, for example placed in a container or pouch.

In one embodiment, the exercise mat of the present invention may comprise a pouch, either built in or attachable to the mat. The pouch may be removable and could be adjusted based on the expected purpose of a mat. For example, a larger pouch could be used for a large 4×6 foot mat for camping, while a smaller 1×3 foot mat might have a small pouch. The pouch could be used for storage or could be designed with special items such as a build in drink compartment. The pouch may be able to be rolled up with the mat, so they can be carried together as a unit. In one embodiment, access to the pouch may be on an outer edge to allow for access without the need to unroll the mat. In another embodiment, access to the pouch may be by a central area opening. In some embodiments, the pouch may contain multiple separated pockets, such as a side pocket or pockets and a central pocket. Straps may also be attached to the mat or to the pouch which may allow for easy carrying, especially when the mat and/or pouch are in a rolled, compacted position.

In varying embodiments, the pouch may be fixed on top of the mat, or may sandwich the top and bottom of the mat, among other arrangements. Further, in some embodiments an opening may face toward the mat, while in other embodiments the opening may face away from the mat. A shape of the pouch may vary without straying from the scope of the invention. In one embodiment, the pouch may have a cross section of a rounded shape, such as semicircular or circular. In another embodiment, the pouch may have a cross section that is approximately squared or rectangular.

The pouch may be made of any material capable of defining an interior space. These materials may be hard or soft, and may vary greatly depending on specific applications. Further, as noted herein, the pouch may be permanently attached to the mat, or may be removable therefrom. Removable embodiments may utilize any structure to removably attach to the mat without straying from the scope of this invention.

Generally, one or a plurality of lights may be disposed on or near a perimeter or a portion of the perimeter of the mat. For the purposes of this disclosure, the term "edge" is used to refer to not only a terminal edge of the mat, but also a portion of the mat adjacent to the face, or slightly inset from the face. As shown and discussed in the various embodiments disclosed herein, the lights can be seen to be on the edge of the mat, which includes the side edge, end edge, top surface edge, and slightly inset from the edge. In some cases, the slightly inset lighting embodiments will have a portion of yoga mat between the lights and the outer side of the mat.

These lights may be oriented in various direction, but generally are configured to illuminate an area around the mat. The lights may be placed in various arrangements including but not limited to pointing in the upward direction or around the edges pointing outward. In one embodiment LED light strips may be laid into pre-formed channels in the mat. In a further embodiment, the LED strip may be attached to the mat by hook and loop fasteners so they can be easily removed without damaging the mat. In yet another embodiment, the light or lights may be directly connected to the mat. In many embodiments, the lights may be housed in a protective flexible sheathing or sleeve. In some embodiments the lights may be used to create a glowing logo, pattern, or picture on top of the light casing. In one embodiment the lights may also be placed inside the pouch behind a translucent logo to cause it to glow.

The lights may be controllable by an attached microprocessor either through physical buttons connected to the microcontroller or a separate remote control unit, including but not limited to infrared, radio frequency, Bluetooth or wifi, and may be syncable with other nearby devices.

In varying embodiments, the microprocessor may control the color, brightness and speed of the lights, as well as communicate with other mats either directly or through another device such as a phone. In some embodiments the controller may also alter the lights based on external feedback signals such as music or remaining battery life. In one embodiment the controller will be programmed with time settings so that when selected, the colors will change at the selected time interval. For example, a "30 second" program which will change the color every 30 seconds. This could be used, for example, for timing exercises or stretching. In one embodiment the controller may have an open signal input and output connector which would allow several mats to be connected together to synchronize them. Generally, lighting control may be achieved by a computerized controller to act as a visual metronome or visual pace keeper. The lights may change in different cycles depending on control intended by the controller, such as pre-programmed cycles, or cycles controlled by a control input (remote, computer interface, and the like).

It should be understood that the illuminating mat and related elements may be of varying size, shape, color, and material without straying from the scope of the present invention. The lights may be any type, including but not limited to RGB LEDs, addressable LEDs, or OLEDs.

BRIEF DESCRIPTION OF THE DRAWINGS

Embodiments of the present invention will now be described by way of example only, with reference to the attached figures wherein.

DETAILED DESCRIPTION

Figure 1:
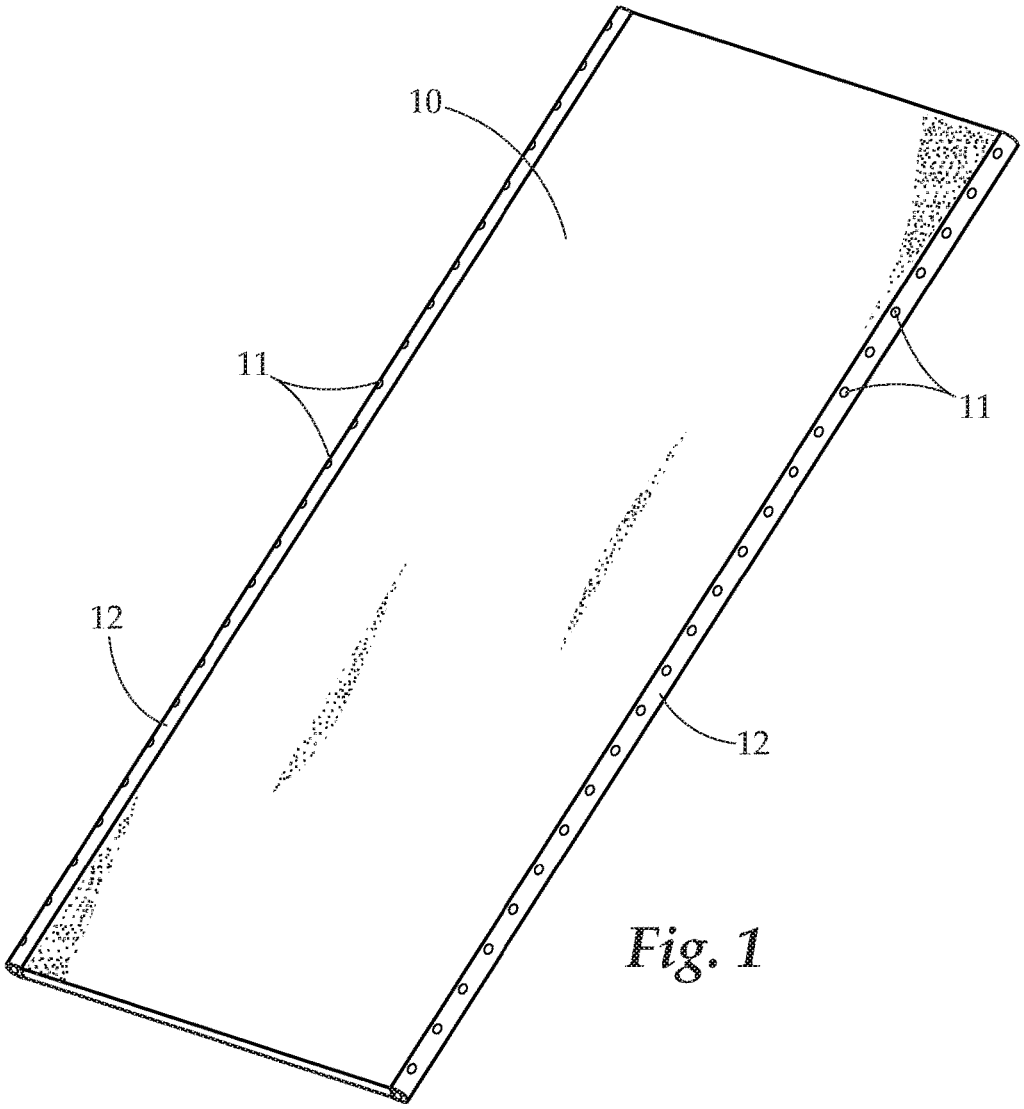
FIG. 1 provides a perspective view of an embodiment of the present invention.

This invention pertains to an electronically powered, illuminating "mat" or "pad" which may be used as a temporary surface for any various activities, such as involving yoga or exercise, sitting or resting, or for example as the floor of a camping tent. More particularly, a battery powered mat in a custom shape, which is easily transportable and portable but also contains built-in high powered LEDs to act as lights benefiting the user with additional visibility at night, as well as mood lighting to for an overall enhanced experience and timed function for exercise purposes.

Furthermore, this invention pertains to an electronically powered illuminating exercise mat controlled by a microcontroller which may be connected to said LEDs in order to, through physical buttons or an IR (infrared) or RF (radio frequency) remote control, provide a unique and customized functionality. Particularly, the microcontroller may allow the user to select a pre-programmed control algorithm to quickly and easily set the lights to change to a specific set of instructions. For example, to cause the LEDs to change color every 30 seconds, for timing a workout.

Furthermore, this invention pertains to a storage pouch/container which may be attached to said mat which may house the power source, and may also serve as a container to store belongings or other items, such as drink vessels. In another emboidment, the power source may be fully encased within the mat. The mat may be designed in such a way that the pouch can be removable and the mat can be rolled up and stored with or without the pouch. However, if the pouch is attached, the mat can be rolled up with the pouch, and used as a multi-functional backpack.

One embodiment of the invention involves the combination of several existing items to create a mat which lights up and can be used for illumination, for timing workout exercises, as well as for carrying small items all in one. The mats may be made using the same existing processes and materials as existing exercise mats, but may offer a wider variety of sizes and shapes, since the uses for such mats may expand due to this invention. A particular embodiment may be made in the standard yoga mat size of approximately 74 inches long by 24 inches wide and about 10 mm thick.

The mat of the present invention may be formed generally of flexible and soft materials, typically elastomeric materials. Examples of such materials include, but are not limited to rubber, flexible plastic, foam, and the like. In one embodiment, the mat may be made of an elastomeric material such as NBR, TPE, PVC, or other polymers.

The mats may be made with two pre-molded channels where the lights may be attached. The channels may be approximately 6 mm deep and 12 mm wide and may run along the left and right side edges of the mat. Other embodiments may have channels along all four side edges, for example for a 4 ft.×6 ft. mat for being used in a camping tent. The channels are meant to be approximately the same size as the light emitting diode ("LED") strips and/or lights in a flexible sleeve. The channels keep the LED strips flush and allow the user to roll on the mat freely.

LED strips can be procured in various lengths, types and sizes with various coatings. They are available in standard RGB format where all the lights change to the same color at the same time, or in addressable format where each individual LED can be different color. They are also available as organic LEDs. One embodiment for this invention may use non-addressable 5 volt 5050 RGB strips approximately one (1) inch shorter than the length of the pre-molded channels. The reason for the removed inch is to allow room for the connecting wires without them extending past the edge of the mat. The reason for using the 5 volt strips is so that the power source can also be used for charging common personal electronics such as cell phones. The LED strip may be inside a flexible silicone sleeve which is sealed on each end. In another embodiment, the LED strip may be covered by a protective gel or other sealant coating. Such a coating may provide a similar protective structure as the silicone sleeve. For example, the silicone sleeves may be made opaque to diffuse the light to protect the user from directly hurting their eyes, so that the LED circuits cannot be seen directly and so the strip may glow uniformly. However, the silicone sleeves may be any color or transparency without straying from the scope of this invention. LED strips may be attached to the mat using hook and loop style strips, or any other connection structure, such as magnets, buttons, pressure fit, adhesive, snap fitting, and the like. In a hook and loop embodiment, the hook side of the strip will be connected to the bottom of the LED strip, while the loop side will be laid into the pre-molded channels. A hook and loop connector system may be advantageous to connect the lights to the mat is so that they can be removed at will without damaging the mat, for example for easy replacement.

The LED strips may be connected to a controller. In order to synchronize two different strips, they should both be connected to the same controller, which means a signal splitter may be required. In one embodiment, each LED strip may be connected to the output of a splitter, while the input may come from one microcontroller. The splitter and micro controller may be connected with sufficient lengths of cable so that they can reach the power source and be located inside the container or pouch. In a particular embodiment, a single controller may be in communication (such as wireless communication) with a plurality of different light sources on a plurality of different mats. In such an embodiment, a single controller may control lighting on multiple mats. This may allow for synchronized mat lighting, or controlled differences in mat lighting, depending on embodiment.

There are many different types of controllers available in many sizes. They can be customized to receive various signals and produce various outputs. In a particular embodiment, a small microcontroller may be used. Typical controllers for LED strips allow the user to turn the lights on and off, change the color, adjust brightness, cause the lights to flash or fade between different combinations of colors, and strobe certain colors. They also typically allow the user to adjust the speed of the flash or fade, but the speed can only be adjusted in small and limited increments, up or down. There is currently not a way to set the changing to a specific time interval. Some controllers include a microphone to allow the colors to change based on audio feedback. The control can be enacted through physical buttons connected to the LED strip, through RF or IR remotes, or by a phone or other device via Bluetooth or wifi communication. One embodiment of this invention may use a microcontroller with RF remote control. The controller may use standard programs and hardware to allow the lights to turn on and off, adjust the level of brightness, change color, and flash and fade between colors. In addition however, one embodiment may use a customized program which will be created specifically for this invention. The program may instruct the lights to flash or fade between colors in certain specified time intervals. The remote control may be made with several customized buttons with set time intervals printed on them. When the user selects a specific number, the lights will change in that interval. This will allow the user to use the lights as a visual metronome in order to keep the tempo of their workout, or to time their exercises without the need for counting or using a stopwatch. A particular embodiment of this invention may provide pre-programmed buttons for one (1), two (2) five (5), ten (10), fifteen (15), thirty (30), sixty (60), and one hundred eighty (180) seconds. This timing may be used to, for example, instruct on breathing timing (1-2 second interval), position hold timings, and the like.

The controller may be connected to a power source. The power source may be connected directly to the mat near the LED strips, or it may be placed inside a container. One embodiment of this invention may use a readily available portable battery with a 5 volt output as the power source, such as one used for charging cell phones. The power source must be capable of outputting sufficient amperage for powering both strips for the desired length of time. In one embodiment of this invention, the power source may have an output capable of supporting 3 amps to both strips can be powered by one power source, and may have a 5000 mAh or greater capacity so the lights can last for 4-6 hours or more.

The power source, controller, splitter if used, and all connecting cables may be attached to the mat. They could be attached directly or through a number of various available methods. In one embodiment they may be attached by inserting them into a specially designed case, and the case will be attached to the mat. The case can then serve multiple purposes and store other items as well. This may allow the mat to become multi-use pack, which can be unrolled into a light up mat. A particular embodiment may have a soft but padded flexible case approximately the same width as the mat at about 24 inches, and about 4-6 inches long, and 1-2 inches thick. The case may be made of a water resistant material with a dual-zipper across the entire width and down the majority of each side, so that a side of the case may be accessed while the mat is rolled up if the user so desires. The pouch may double as a pillow. There may be access points for the cables to enter and exit and loops along the bottom for routing the cables. There may also be a smaller, more rigid pocket inside the container specifically for the power source and microcontroller. There may also be a small non-rigid pocket on the other side facing sideways so it could be used to store items which the user may want to access while the mat is rolled up. There may be a small hook and loop patch on the outside of the container for connected the remote control, and a pocket inside for storing it when not in use. There may also be a thin hidden pocket along the back of the container which may contain the straps to be used for keeping the mat rolled and carrying it. There may be a series of elastic bands on the front side of the case for storing additional items when the mat is unrolled, such as a small towel or drink bottle.

The container may need to be attached to the mat. This may be done with a permanent adhesive or mechanical hardware, or it may be designed to be removable. One embodiment of this invention may use hook and loop fasteners so that it is removable. A patch of hook and loop fastener in similar dimensions of the case may be adhered permanently to the mat, and the opposing hook and loop side may be permanently attached to the back of the case. This arrangement may be below the rear pocket so the rear pocket is accessible. In many embodiments, the container may be attached to the mat at least partially on or over a top surface of the mat.

Turning now to FIG. 1, an embodiment of the present invention is provided. The exercise mat 10 can be seen having two light strips 11 along its long edges. In other embodiments, light strips 11 may extend along the short edges instead, or along all four side edges. Mat 10 is generally formed of a soft cushioning material to allow a user to exercise on it, as noted earlier. The mat 10 has a substantially flat surface, which may be textured, form apertures, and the like, though all of these structures may be considered substantially flat for the purposes of the present disclosure. As used herein, the term substantially flat surface applies to a mat 10 that can be laid on a surface and has a top surface that roughly contours to the surface on which it is laid. For example, the mat 10 may be formed as a yoga mat. The light strips 11 may be any sort of lighting structure. In the embodiment shown, the lights 11 are formed as a plurality of LEDs encased in a sleeve 12. The structure shown is flexible, and may be rolled and unrolled in storage and use modes, respectively.

Figure 2:
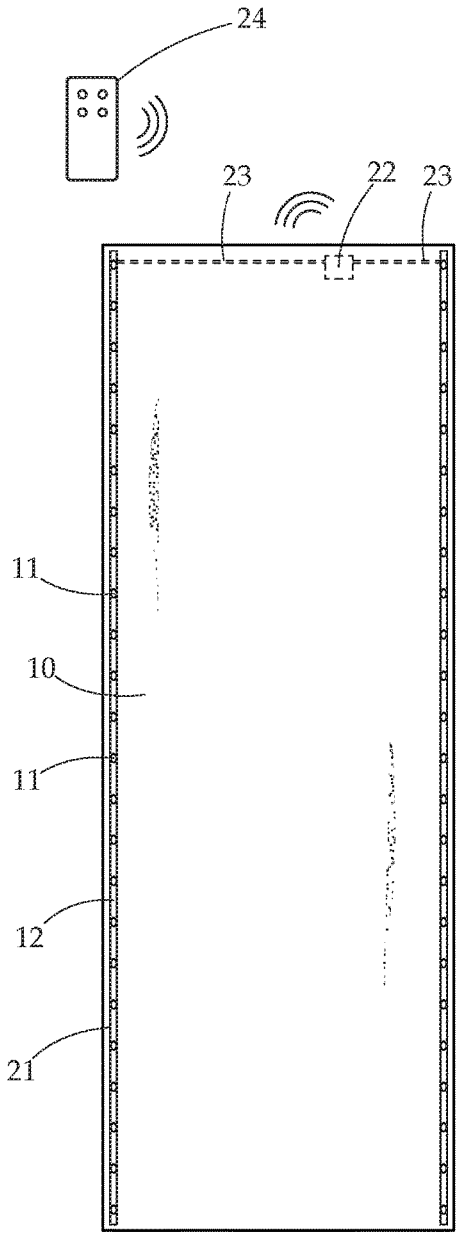
FIG. 2 provides an elevation view of another embodiment of the present invention.

FIG. 2 provides an elevation view of another embodiment of the present invention. In this view, mat 10 has lights 11 along its lengthwise edges. In this embodiment, mat 10 defines channels 21 in which the lights 11 can sit. Mat 10 extends slightly beyond the light sleeve 12 and the sleeve 12 sits within the channels. It should be understood that while this embodiment does not show the lights 11 exactly on the outer perimeter edge of the mat 10, for the purposes of this disclosure, this structure is considered as being lights 11 on the perimeter edges of the mat 10. A controller 22 (such as a computerized controller programmable and/or reprogrammable to control the lights based on an input) comprising a microprocessor is positioned on or in the mat 10. In one embodiment the remote 24 may comprise a plurality of inputs or a single touch screen with multiple different input areas to control different functionality of the light strips 11. For example, remote 24 may provide an input to controller 22 to control light activation, light activation timing, color change, brightness, a pulsing action, flashing pace, and the like. The controller 22 is configured to control operation of the light strips 11. As discussed above, the controller 22 is capable of controlling one or more aspects of the light operation. Wires 23 connect controller 22 to light strips 11 to allow for electronic communication between controller 22 and lights 11. A remote 24 is in wireless communication with the controller 22. Remote 24 is configured to provide instructions to controller 22 which may adjust or control aspects of the light operation.

Figure 3:
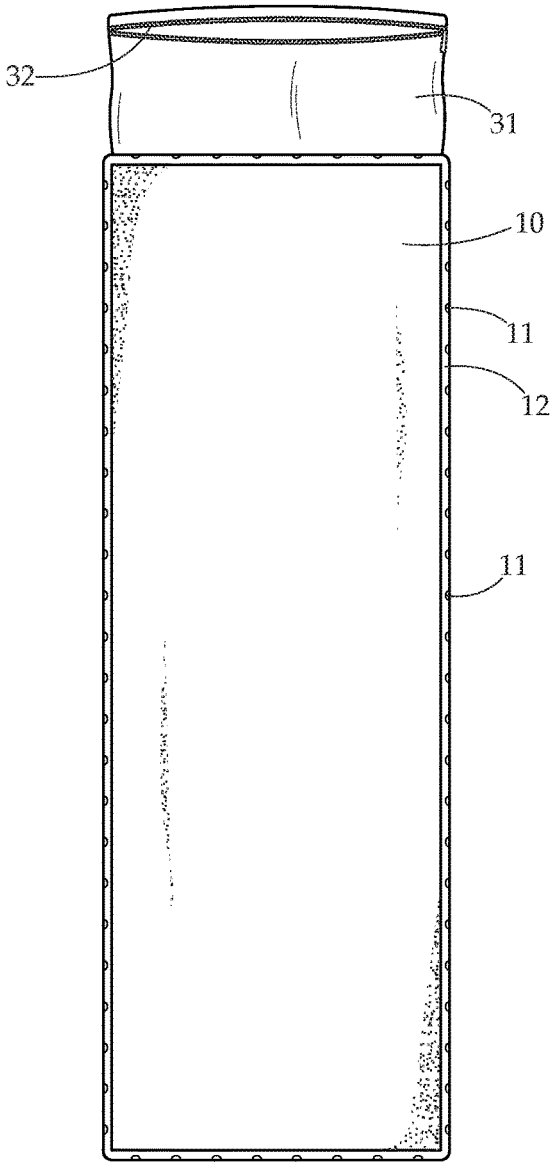
FIG. 3 provides an elevation view of yet another embodiment of the present invention.
Figure 6:
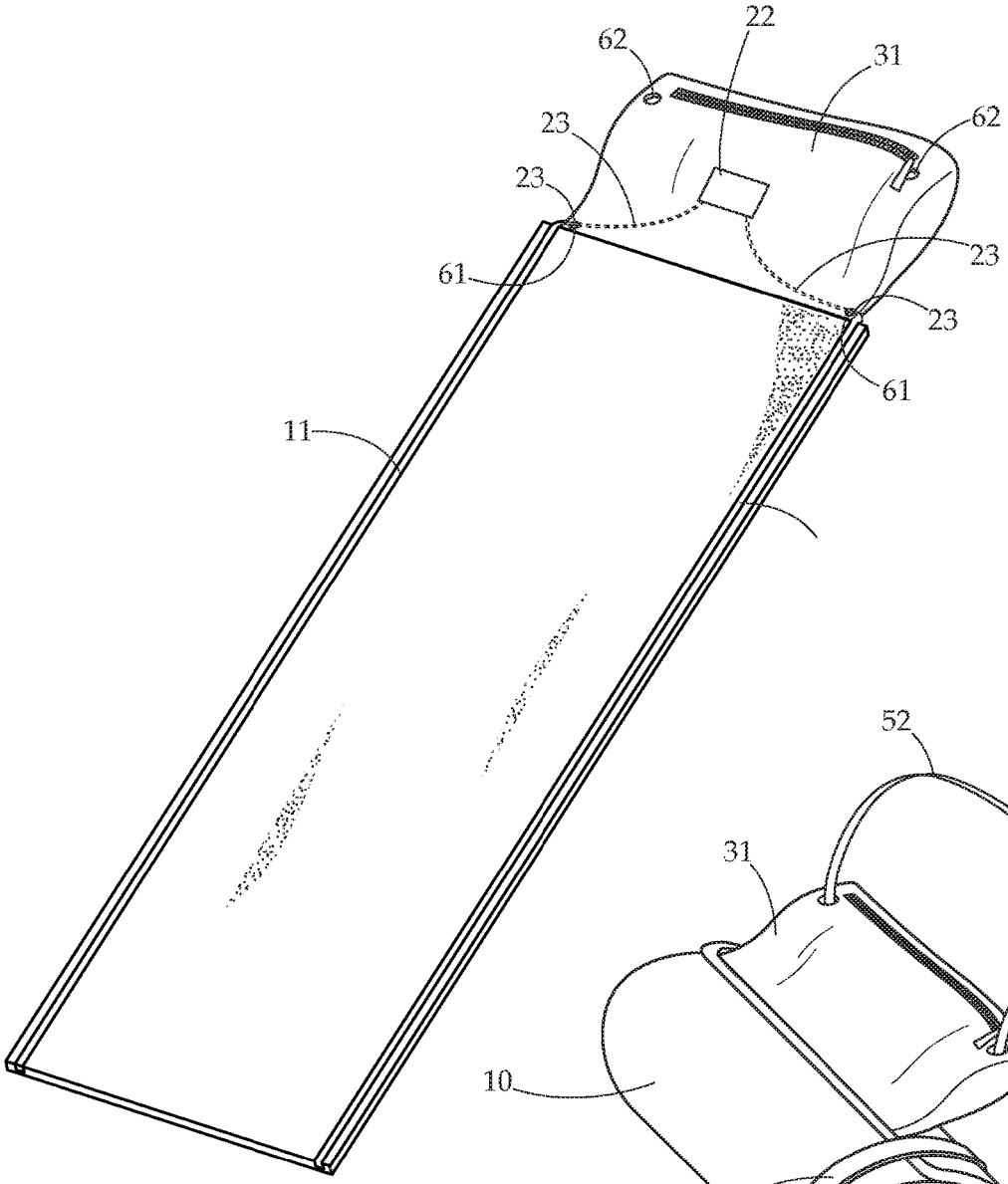
FIG. 6 provides a perspective view yet still another embodiment of the present invention.
Figure 7:
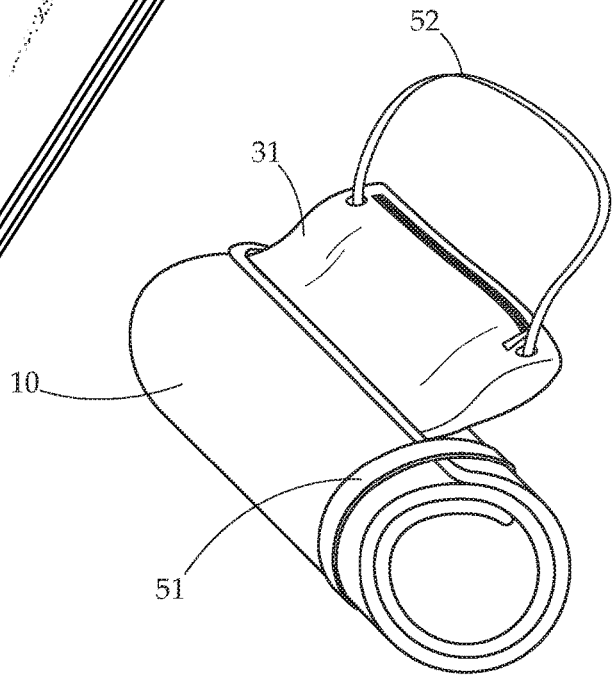
FIG. 7 provides a perspective view of another rolled embodiment of the present invention.

FIG. 3 provides an embodiment of the present invention having a storage pouch attached thereto. The storage pouch 31 is attached to a top end of the mat 10. The pouch 31 may be of varying sizes depending on embodiment, and may be connected to the mat 10 in any manner. The pouch 31 has an opening 32 to allow access to the pouch 31 interior. In this view, lights 11 are positioned around all four side edges of the mat 10. In FIG. 6, another embodiment can be seen having electronic components positioned within the storage pouch 31. In this view, pouch 31 has an opening 32 on a side, although in varying embodiments the opening may vary in position. For example, wires 23 connect controller 22, power source, remote receiver, and the like to the lights 11 through wires 23 passing from the lights 11 through opening 61 into an interior of the pouch 31. In the embodiments shown, the pouch 31 may serve a number of functions or combinations of functions such as providing a padding (the padding or inflatable bladder being positioned within at least a portion of the pouch). Further, the pouch 31 may also provide an anchor point for a wrapping strap and a shoulder strap, as shown in FIG. 7. In an embodiment similar to that of FIG. 7, the pouch 31 may be on an inside of the rolled mat 10, such that the mat 10 wraps around pouch 31.

Figure 4:
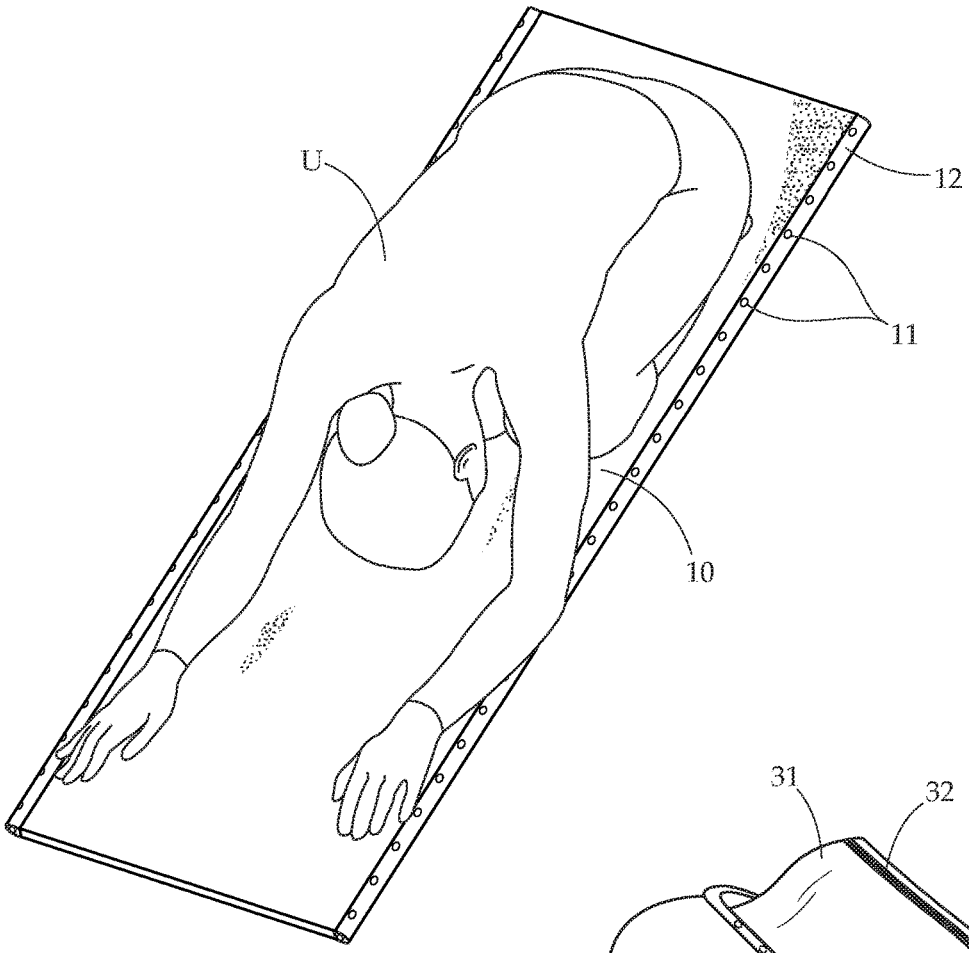
FIG. 4 provides a perspective view of an embodiment of the present invention.

FIG. 4 shows a perspective view of an embodiment of the present invention. The mat 10 is being used by user U. Lights 11 can be illuminated, as discussed herein. The lights 11 in this embodiment are covered by sleeve 12, and are oriented to direct light in an approximately 180 degree arc facing outward from the mat, so that a floor on which the mat is resting is partially illuminated.

Figure 5:
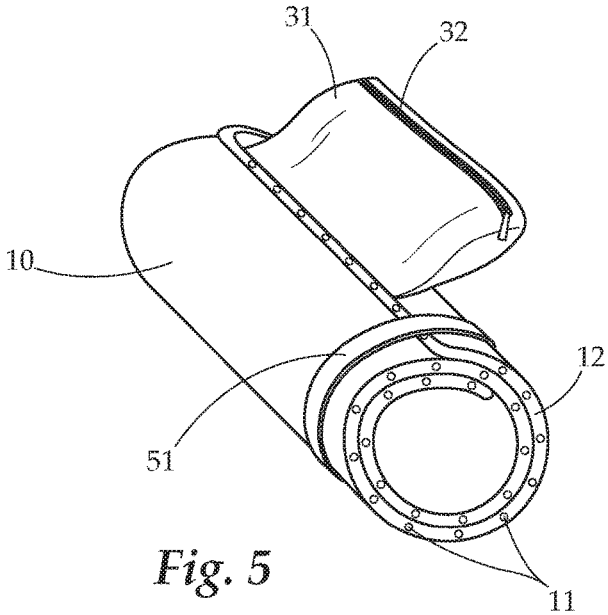
FIG. 5 provides a perspective view of a rolled embodiment of the present invention.

FIG. 5 shows an embodiment of the present invention in a rolled position. The mat 10 of the present invention is configured to be rollable for storage, transportation, and the like. As can be seen, the lights 11 on the perimeter of the mat 10 are also rollable. Strap 51 wraps about the mat 10 to keep it rolled. Also, strap 51 or additional straps (not shown) may be used as a carrying strap to allow a user to carrying using one or two shoulder straps, for example. In such an embodiment, pouch 31 may double as a backpack style carrying pack. FIG. 7 provides another view of an embodiment of the present invention in a rolled position. Here, the strap 51 is anchored on an outer surface of the pouch 31. In the embodiment shown, the strap 51 may be formed of an elastic material such that it may be stretched over the rolled mat 10 to hold it in place in the rolled position, however, other structures of the strap may be used to hold the mat in the rolled positon without straying from the scope of this invention. Further shown in FIG. 7 is a shoulder strap 52 which is connected to the pouch 31. When in the rolled position, the shoulder strap 52 may be slung over a shoulder of a user, or used as a handle or carrier to provide convenient carrying of the device.

Figure 8A:
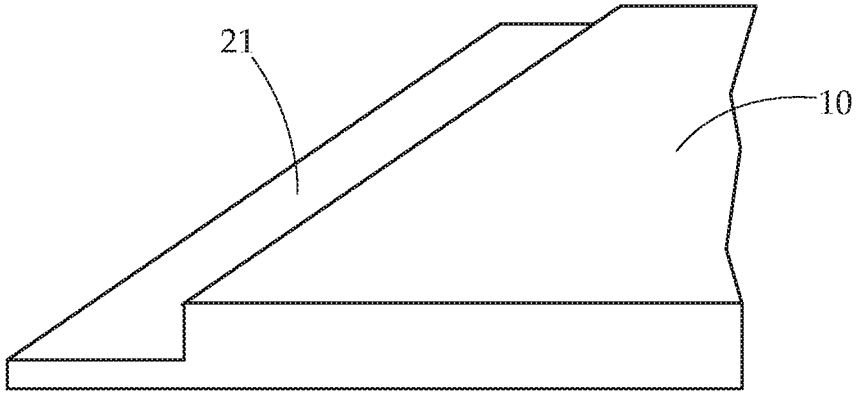
FIG. 8A provides a detail view of an embodiment of the present invention.
Figure 8B:
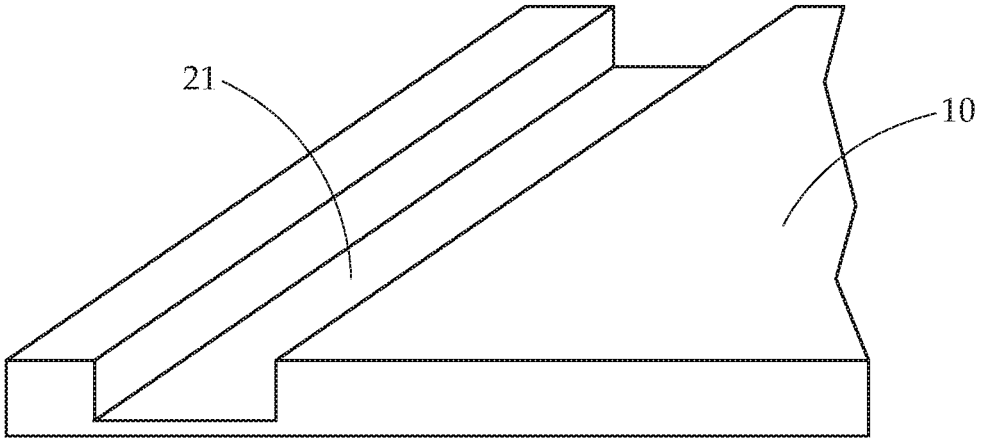
FIG. 8B provides a detail view of another embodiment of the present invention.

FIGS. 8A and 8B provide detail views of embodiments of the mat having recessed channels. In FIG. 8A, recessed channel 21 is at on outer side of the mat 10 at the side edge. In FIG. 8B, recessed channel 21 is on an edge of the mat 10, but slightly inset so that a portion of the mat 10 is beyond the channel 21 on the side of the mat 10.

Figure 9:
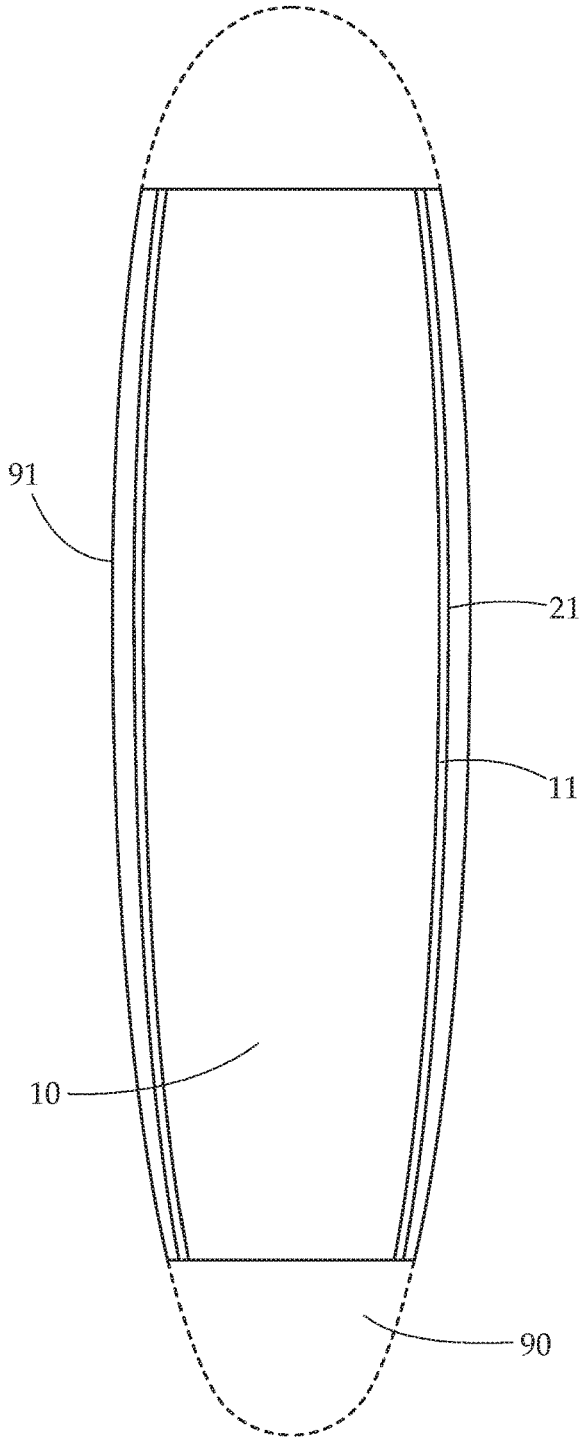
FIG. 9 provides an elevation view of yet another embodiment of the present invention configured for use on a paddle board.

FIG. 9 provides a view of a mat configured for use on a stand up paddle board. In this view, the mat 10 has curved side portions 91 which correspond to a curving shape of a stand up paddle board 90. Lights 11 are positioned in channel 21 to provide illumination. In other embodiments, the lights 11 may be connected to the mat 10 in any manner, such as those discussed throughout this disclosure, and need not be secured in the channel 21 as shown.

Figure 10:
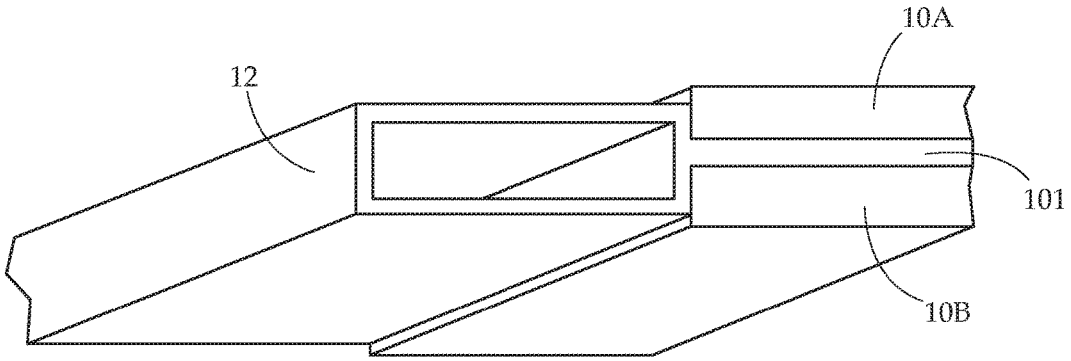
FIG. 10 provides a detail view of yet still another embodiment of the present invention.

FIG. 10 provides a detail view of another embodiment to connect a light sleeve 12 to the mat 10. Specifically, a ridge 101 of sleeve 12 extends into mat 10 and is covered by a top mat portion 10A and a bottom mat portion 10B. While the ridge 101 is shown extending from an approximately central portion of sleeve 12, it should be understood that it may extend from any portion of the sleeve, such as a bottom or top edge, among others. The ridge 101 may be connected between the portions by, for example, adhesive, plastic welding, friction, and the like. Sleeve 12 forms an opening into which lights may be positioned, either permanently or removably.

Figure 11:
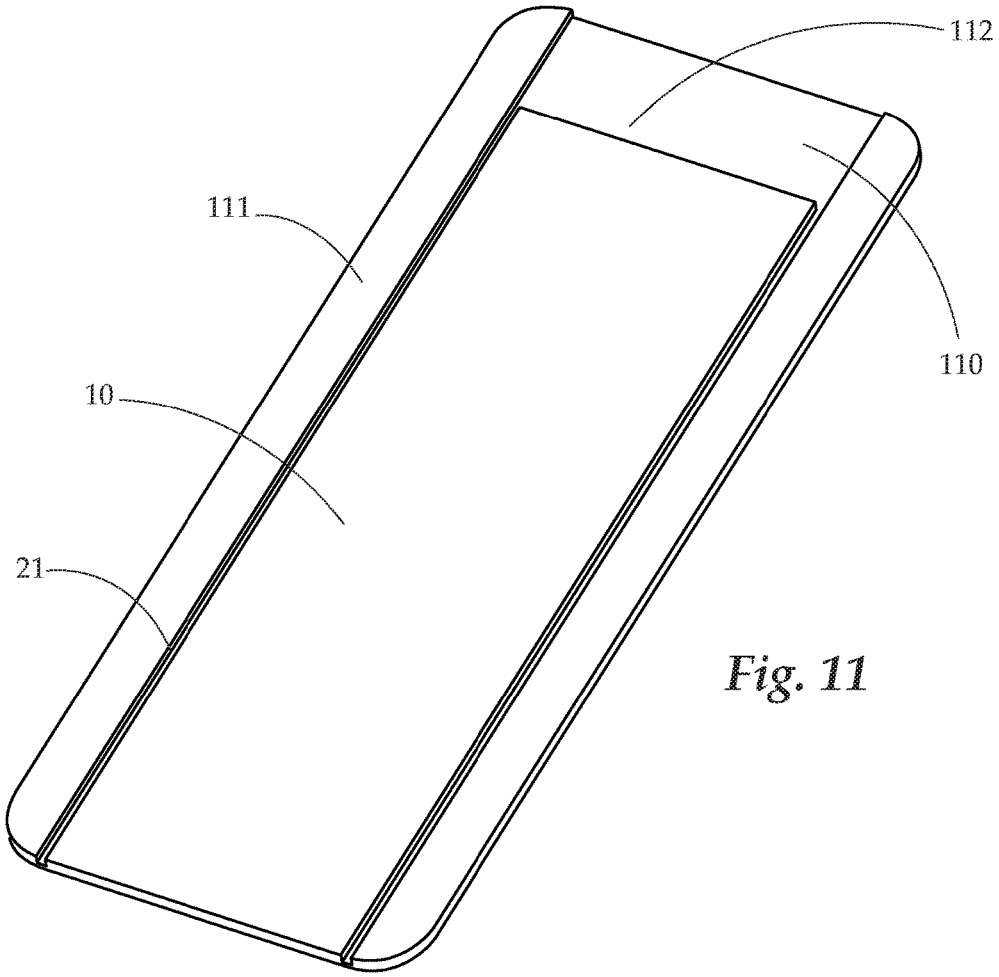
FIG. 11 provides a perspective view of another embodiment of the present invention.

FIG. 11 provides a view of another embodiment of the illuminated mat. In this embodiment, the mat has a top mat layer 10 and a lower layer 110. The lower layer 110 has a larger surface area than top mat layer 10 and has lower layer side portions 111 that extend beyond both ends of the top mat layer 10. A spacing between the lower layer side portions 111 and top may layer 10 defines channel 21, into which lights (not shown) may be secured. A spacing 112 formed by the lower layer 110 extending past a widthwise end of the top mat layer 10 may provide an area to removably or permanently secure a pouch (not shown) or to place loose items, among other functions. This embodiment may be formed in numerous ways, including, but not limited to laminating the top mat layer 10 to the lower layer 110, or removing portions of the lower mat layer 110 to define the recessed portions/channel at 112 and 21.

Figure 12:
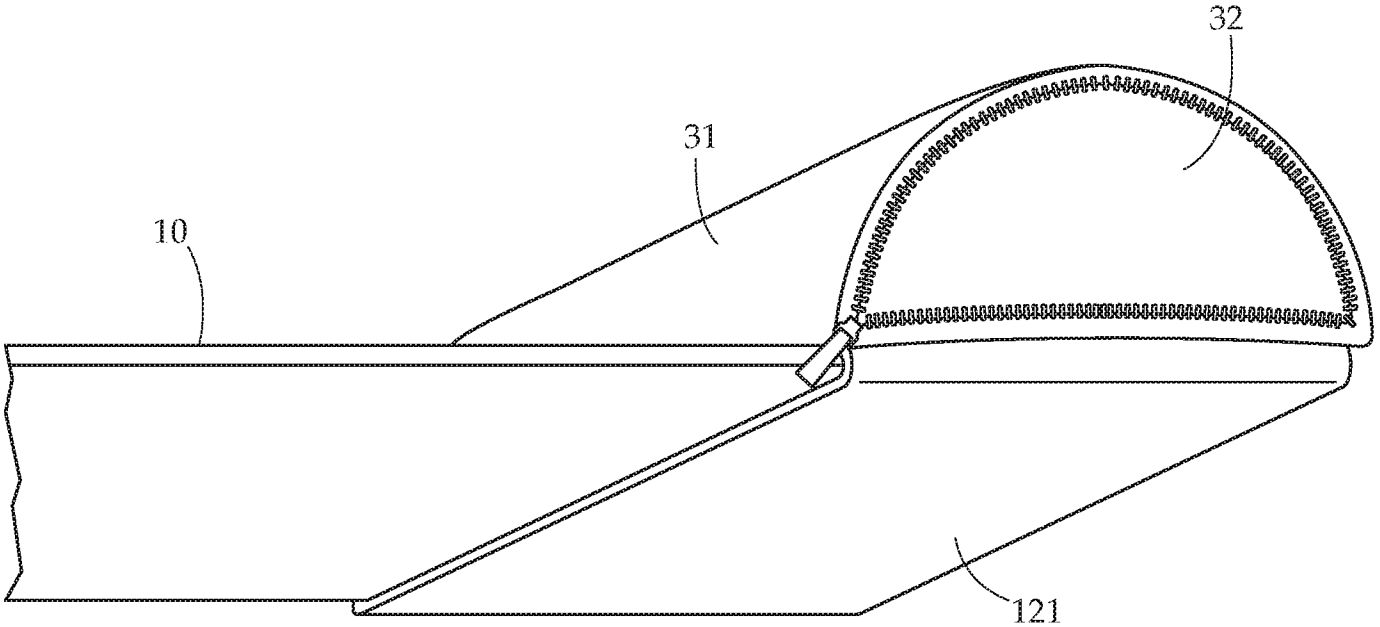
FIG. 12 provides a view of an embodiment of the present invention having the pouch enveloping a portion of the mat.

FIG. 12 provides a view of an embodiment of the present invention having the pouch enveloping a portion of the mat. In this view, the pouch 31 is connected to the mat 10 by enveloping a portion of the mat 10 at envelope 121. As such, a portion of the pouch 31 covers both a top and a bottom portion of the mat 10. Adhesives, hook and loop connectors and any other connection structure may be used to hold mat 10 in place within envelope 121. In this embodiment, a side opening 32 can be seen. The side opening allows access to an interior of the pouch 31, and further, the mat can be wrapped around the pouch 31 and still allow access to the pouch 31 interior using the side opening 32.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

Those skilled in the art will readily observe that numerous modifications, applications and alterations of the device and method may be made while retaining the teachings of the present invention.

What is claimed is:

1. An illuminating exercise mat comprising:

a mat body having a substantially flat surface, the mat sized to receive a human user on the surface;

a first light attached to a first lengthwise perimeter edge of the mat body;

a second light attached to a second opposite lengthwise perimeter edge of the mat body;

a power source configured to provide electricity to activate the first light and the second light;

wherein the first light is an elongate LED strip comprising a plurality of LEDs extending along the first lengthwise perimeter edge of the mat body, the first light positioned to direct light outwardly from the first lengthwise perimeter edge, and wherein the second light is an elongate LED strip comprising a plurality of LEDs extending along the second lengthwise perimeter edge, the second light positioned to direct light outwardly from the second lengthwise perimeter edge;

wherein the first light is attached to the mat body by seating in a first channel defined by the substantially flat surface of the mat body, the first channel extending along the first perimeter edge;

wherein the second light is attached to the mat body by seating in a second channel defined by the substantially flat surface of the mat body, the second channel extending along the second perimeter edge;

wherein each LED strip is covered by at least one of a sleeve or a protective coating; and further comprising a controller, the controller having a processor configured to control an operation of the first light and the second light; and a storage pouch attached to the mat, the storage pouch defining an interior storage space, and having a first opening providing access to the storage space, the power source and the controller positioned within the interior storage space of the pouch, a wiring passing through one or more wiring openings of the storage pouch to provide electronic communication between the power source, the controller, and the first light and to provide electronic communication between the power source, the controller, and the second light.

2. The illuminating exercise mat of claim 1 wherein the controller is configured to adjust a brightness of the first light and the second light.

3. The illuminating exercise mat of claim 1 wherein the controller is configured to change a color of the first light and the second light.

4. The illuminating exercise mat of claim 1 wherein the controller is configured to adjust a timing of a change of the first light and the second light.

5. The illuminating exercise mat of claim 4 wherein the controller is configured to adjust the timing of the change to be at one of a fifteen, thirty, forty five, sixty, and ninety second interval.

6. The illuminating exercise mat of claim 1 wherein the controller is configured to control a pulsing of the first light and the second light.

7. The illuminating exercise mat of claim 1 wherein the controller is further in communication with a second exercise mat comprising a third light, the controller configured to control an operation of the third light on the second exercise mat.

8. The illuminating exercise mat of claim 1 wherein the mat body is a yoga mat.

9. The illuminating exercise mat of claim 1 wherein the power source further comprises an electrical outlet port configured to charge a portable electronic device.

10. The illuminating exercise mat of claim 1 wherein the mat body is rolled into a compacted position.

11. The illuminating exercise mat of claim 1 wherein the mat body is rolled into a compacted position, the mat being wrapped about the storage pouch such that the storage pouch is on an inside of the mat body in the rolled position.

12. The illuminating exercise mat of claim 1 wherein the first light is positioned on a first lengthwise side of the mat body, and wherein the second light is positioned on a second opposite lengthwise side of the mat body.

13. A tent assembly comprising the illuminating exercise mat of claim 1 positioned on a floor of the tent.

14. An illuminating exercise mat comprising:

a mat body having a substantially flat surface, the mat sized to receive a human user on the surface;

a first light attached to a first lengthwise edge of the mat body;

a second light attached to a second opposite lengthwise edge of the mat body;

a power source configured to provide electricity to activate the first light and the second light;

wherein the first light is an elongate LED strip comprising a plurality of LEDs extending along the first lengthwise edge from a first widthwise edge of the mat body to a second widthwise edge of the mat body, and wherein the second light is an elongate light extending along the second lengthwise edge;

wherein the first light is attached to the mat body by seating in a first channel defined by the substantially flat surface of the mat body, the first channel extending along the first perimeter edge the first channel being inset from an outer side of the mat body, the first light positioned to direct light outwardly from the first lengthwise edge;

wherein the second light is attached to the mat body by seating in a second channel defined by the substantially flat surface of the mat body, the second channel extending along the second perimeter edge the second channel being inset from a second outer side of the mat body opposite to the first channel, the second light positioned to direct light outwardly from the second lengthwise edge;

wherein each LED strip is covered by at least one of a sleeve and a protective coating; and further comprising a controller, the controller having a processor configured to control an operation of the first light and the second light; and a storage pouch attached to the mat, the storage pouch defining an interior storage space, and having a first opening providing access to the storage space, the power source and the controller positioned within the interior storage space of the pouch, a wiring passing through one or more wiring openings of the storage pouch to provide electronic communication between the power source, the controller, and the first light and to provide electronic communication between the power source, the controller, and the second light.

* * * * *